United States Patent [19]

Dayus

[11] Patent Number: 4,672,890

[45] Date of Patent: Jun. 16, 1987

[54] LIGHTWEIGHT LOAD BEARING REGISTER

[75] Inventor: Lloyd G. Dayus, Memphis, Tenn.

[73] Assignee: Rachels Industries, Inc., Memphis, Tenn.

[21] Appl. No.: 874,136

[22] Filed: Jun. 13, 1986

[51] Int. Cl.[4] ..... F24F 13/08

[52] U.S. Cl. ..... 98/114; 98/103

[58] Field of Search ..... 98/40.2, 101, 103, 114; 52/473, 664, 668, 669

[56] References Cited

U.S. PATENT DOCUMENTS

| | | | |
|---|---|---|---|
| 812,158 | 2/1906 | Tuttle | 98/114 |
| 1,969,437 | 8/1934 | Truax | 98/114 |
| 2,464,442 | 3/1949 | Roo | 98/114 X |
| 2,849,943 | 9/1958 | Zurawski | 98/114 |
| 3,589,265 | 6/1971 | Hedrick | 98/114 |

*Primary Examiner*—Harold Joyce

*Attorney, Agent, or Firm*—George A. Rolston

[57] ABSTRACT

A lightweight load bearing register having a frame with a generally L-shaped configuration, the frame being in four pieces joined at the corners, and having a supporting grid of groups of transverse and longitudinal strips of sheet metal, one of the groups being formed of a single thickness of sheet metal, with notches at spaced intervals, and the other group being formed of two thicknesses of sheet metal, having a thickness thinner than one-half of the thickness of the first group, the strips in the second group defining an elongated folded blade-like structure with a hollow interior, with a space between opposite sides which is substantially equal in width to the thickness of the sheet metal of which they are formed, and radiussed along at least their upper extremity, the width of the blade members being slightly greater than a dimension of the notches in the first group so that when the second group is forced into the notches they will be squeezed, reducing the spacing between their opposite sides.

10 Claims, 9 Drawing Figures

LIGHTWEIGHT LOAD BEARING REGISTER

The invention relates to an air register, and in particular to an air register of lightweight load bearing construction which is adapted to be placed in a floor for example, and sustain the weight of persons walking about on the floor.

BACKGROUND OF THE INVENTION

Air handling systems involve both outlet or distribution registers and return registers.

The air outlet registers are in many cases of relatively small dimension, typically being 4"×10", and are usually located in walls or ceilings of a structure.

Return registers are, however, usually of much larger dimensions, in the region of for example 12"×24", or 12"×36". In most domestic construction for example the larger dimensions of the return registers are dictated by the manner in which the air distribution and return ducting is incorporated in the building structure. Distribution ducts are usually of relatively small dimensions, for example 4"×10", and are led to every room in a dwelling. On the other hand, the return ducting is usually much larger, and the return registers will be located at only two or perhaps three different locations in the dwelling, usually in stairwells or in open rooms. The air return ducts are usually of much larger dimensions than the distribution ducts, because there are fewer air return registers and the same volume of air must be distributed, and returned, continuously.

The much larger size of the return ducts in many cases means that it is difficult to incorporate them in a typical dwelling wall, in which the thickness of the wall is only the thickness of the spacing provided by the studs provided in the wall.

Accordingly, it is common practice to provide air return ducts which are simply in the floor or beneath the basement floor joists. This form of duct is acceptable for return air purposes since the return air usually flows through door ways and stair wells, consequently eliminating the need for hot and cold air circulation in every room.

The return ducts may be in the region of 250 to 500 square inches for example depending upon the volumes of air being circulated.

Because of the location of the return ducts, it is usually necessary to have the return registers mounted on the floor.

As a result of this, it has been necessary in the past, to make floor registers of relatively heavy construction, such that they can bear the weight of persons walking about on the floor. Generally speaking this has been done in a simplified fashion by providing a criss-cross grid of metal strips. The strips running in one direction, usually the shorter direction, will be wider strips, and will be notched to receive and support the somewhat narrower strips running in the other direction.

In some cases, both transverse and longitudinal strips have been notched, somewhat in the fashion of an egg-crate.

A simple frame is provided around four sides of the register, in which the ends of the transverse and longitudinal strips are fastened. The edges of the frames are usually simply spot welded together.

These registers have been used for many years, and have proved more or less satisfactory, that is to say they provide a means of returning air and at the same time support the weight of persons walking on the floor.

However, as the price of steel increases, the cost of such registers increases, and becomes a significant factor. A typical floor register may weigh several pounds.

It is clearly desirable to reduce the amount of steel in such registers if possible, without losing the load bearing capacity.

A further factor in the design of such registers also occurs in the fact that persons will typically walk on them as part of the surface of the floor. Typically, persons walk about the floor in bare feet or stockinged feet. If the edges of the strips forming the register are sharp or burred, then it may cause cuts, or damage to clothing and the like.

In the past, it was common for such registers to be made with strips of steel formed with at least one edge which was subjected to a finishing and radiusing operation so as to avoid this problem. More recently, however, some manufacturers have neglected to do this additional operation to avoid increases in costs.

Clearly, it is desirable to take whatever steps can reasonably be taken to avoid this problem.

The construction of the frames in the past has involved a relatively costly method of holding the two corners of the frame together and spot welding them to a gusset plate. Any improvement that can be made in this operation without loss of rigidity, is to be desired.

BRIEF SUMMARY OF THE INVENTION

With a view to overcoming these various problems and to achieving the advantages described above, the invention comprises a lightweight load bearing register having a frame formed of strip sheet metal, formed into a generally L-shaped configuration along its length, the frame being in four pieces joined at the corners, and having a supporting grid of transverse and longitudinal strips of sheet metal supported by said frame, one of said groups of said transverse and longitudinal strips being formed of a single thickness of sheet metal, and a plurality of notches formed therein at spaced intervals, and the other group of said transverse and longitudinal strips being formed of two thicknesses of sheet metal, having a thickness thinner than one-half of the thickness of said first of said groups, said strips in said second group being roll-formed along their length to provide an elongated folded blade-like structure, defining a hollow interior spacing between the opposite sides of said blade-like structure substantially equal to the thickness of the sheet metal of which they are formed, and radiussed along at least their upper edge, the thickness of said roll-formed blade members being slightly greater than the dimensions of said notches in said first group of strip members, whereby when said second group of strip members are forced into said notches in said first group of strip members, said second group of strip members will be squeezed, reducing the spacing between the opposite sides thereof, and providing a good, tight frictional fit.

More particularly, it is an objective of the invention to provide a register having the foregoing advantages wherein the notches have a predetermined depth less than the overall height of said strips in said second group.

More particularly, it is an objective of the invention to provide a register having the foregoing advantages wherein said notches are formed with a flared mouth portion, tapering towards a reduced diameter main notch portion.

More particularily, it is an objective of the invention to provide a register having the foregoing advantages wherein one end of the frame piece at each corner is cut with an overlapping flange portion underlying the corner of the adjacent end of the adjacent frame piece, and being spot welded thereto to provide a rigid corner construction.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
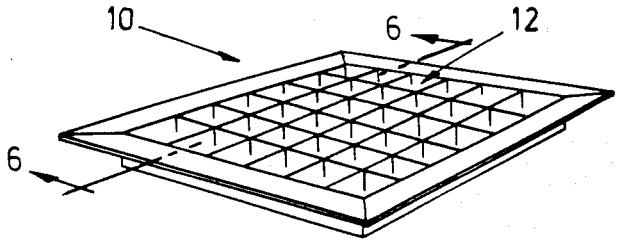
FIG. 1 is a perspective illustration of a typical register according to the invention.

Referring now to FIG. 1, it will be seen that the air register to which the invention is directed, generally comprises a frame 10, adapted to be placed in a suitable rectangular opening in a wall or floor, and a grill portion 12, providing a load bearing structure on which persons can walk, when the register is located in a floor, and at the same time allows for free passage of return air.

Figure 2:
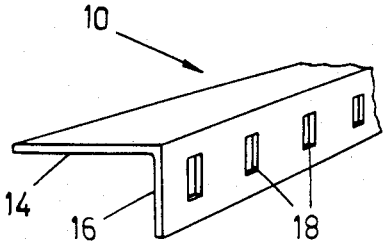
FIG. 2 is a cut-away perspective illustration howing a portion of the frame.

As shown in FIG. 2, each side of the frame 10 comprises a generally L-shaped sheet metal member having side or facing flanges 14, and support flanges 16. The side flanges 14 are adapted to lie on the surface of the floor, and the support flanges 16 extend into the opening.

A plurality of notches or holes 18 are provided in the support flanges 16 for reception of the ends of the cross members of the grill 12 in a manner to be described below.

Figure 3:
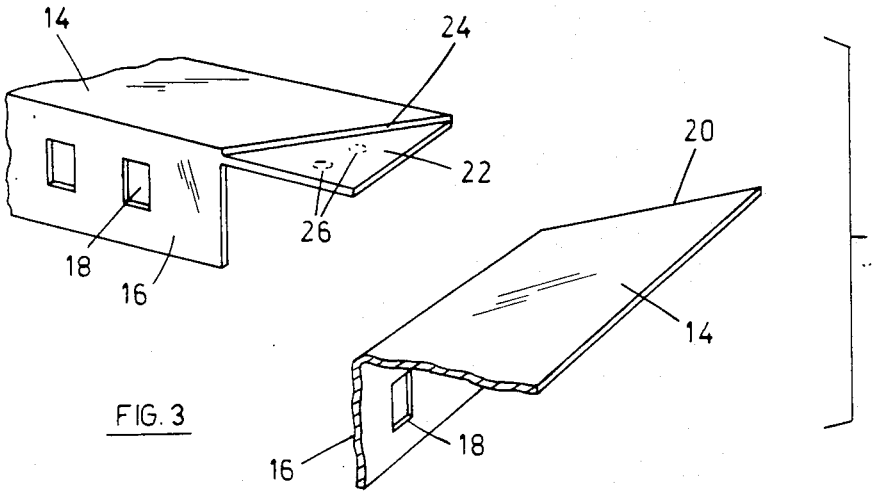
FIG. 3 is an exploded perspective of a corner detail of the frame.

The corners of the frame 10 are formed in this embodiment essentially as shown in FIG. 3.

In this illustration, one end of one portion of the frame 10 is formed with a 45° angle mitre cut 20. The adjacent end of the adjacent portion of the side flange 14 is formed with a triangular overlapping tongue 22, formed integrally with the side flange 14. A sharp double rightangle bend 24 is formed along a 45° angle, so that the tongue 22 is offset inwardly relative to the plane of the side flange 14 by a thickness equal to the thickness of the side flange 14.

In this way, the tongue 22 can be slid underneath the adjacent mitred end of the adjacent side flange 14, and the two adjacent portions of side flanges 14 will then lie in a common plane.

A pair of spot welding points or buttons 26 are formed on the tongue 22. In the assembly operation such buttons facilitate spot welding. This structure forms a stronger more rigid corner than in the past, without the use of any gusset plates or other additional components, and at the same time the actual assembly and jigging of the corner ready for spot welding is greatly facilitated.

Figure 7:
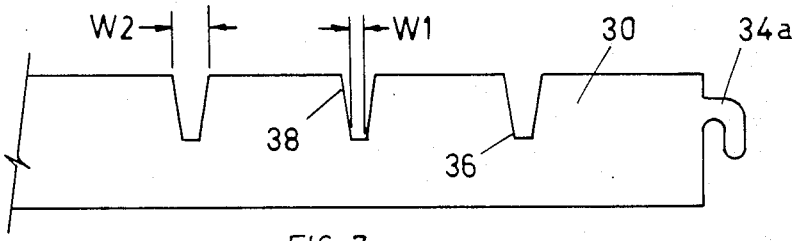
FIG. 7 is an enlarged side elevational view of a portion of the notches in the other one of said strips.

The grill portion 12 of the register shown in FIG. 1 comprises transverse strip members 30 (FIG. 7) and longitudinal strip members 32 (FIG. 4) forming a crisscross grill structure adequate to support the weight of a person walking on the floor.

For this purpose, the transverse members 30 will be seen to comprise strips or bars of sheet metal, having end tongues 34 extending outwardly from each end, adapted to fit within the notches or slots 18 in the flanges 16 of two opposite sides of the frame 10, and formed with hooks 34*a*.

A plurality of equally spaced apart vertical notches 36 are cut in the strip 30, typically extending approximately one-half of the height of the strip 30, depending upon the gauge of metal used. The notches 36 have a predetermined width W1 at their lower ends. They may be formed with angled sides 38, forming an open mouth having a predetermined width W2, wherein W2 is greater than W1.

Figure 4:
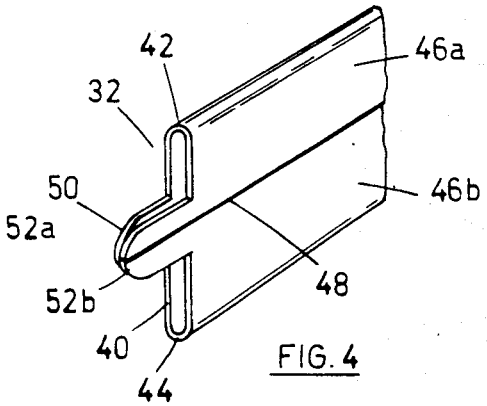
FIG. 4 is a perspective of one end of the roll-formed strip.
Figure 5:
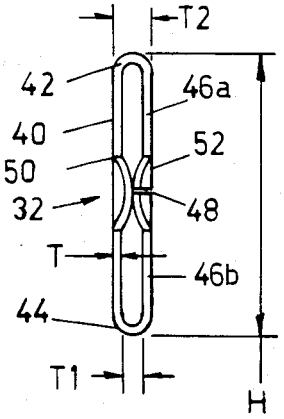
FIG. 5 is an end elevation of the roll-formed strip of FIG. 4.

The longitudinal strips 32, are formed as shown in FIGS. 4 and 5. Strips 32 will be seen to comprise a panel of relatively thin sheet metal defining a continuous sidewall 40, on one side, and upper and lower fold lines 42 and 44.

The two edge portions of the sheet metal panel are folded down to provide partial wall portions 46, lying in a plane parallel to the wall portion 40. The two folded over portions are identified as 46*a* and 46*b* being respectively the upper and lower portions shown in FIG. 4. It will be seen from FIG. 4 that the portions 46*a–b* meet at edges 48, located along the median between the upper and lower fold lines 42–44.

End tabs 50 and 52*a* and 52*b* extend respectively from wall portions 40, and upper and lower wall portions 46*a–b*, being of the same shape and coextensive with one another.

Together the tab portions 50–52 form an endwise attachment means adapted to be received in slots 18 in the other two opposite sides of frame 10.

The tabs are radiussed, and bowed together at their ends for ease of assembly.

The sheet metal from which the strips 32 are formed has a thickness T, less than one-half of the thickness of the strip members 30. Typically, the dimensions may be in the region of 0.065 inches for the strip members 30, and 0.02 inches for the strip members 32.

The strip members 32 are preferably formed with radiussed upper and lower fold lines 42–44, which effectively eliminate the problem sometimes caused by rough edges or burrs on conventional registers.

The sidewall portions 40 and 46 are spaced apart by a thickness T2 which is approximately one-third of the overall thickness T3 of the strip members 32.

In operation, the grid portion 12 is first of all assembled from pieces of strip members 30 and 32 which are cut to a predetermined length. The strip members 32 are forced into the notches 36 in the strip members 30. The overall thickness T3 is somewhat greater than the width dimension W1 of the notches 36, but is about equal, to or slightly less than the width dimension W2 of the open mouth of sides 38.

Figure 6:
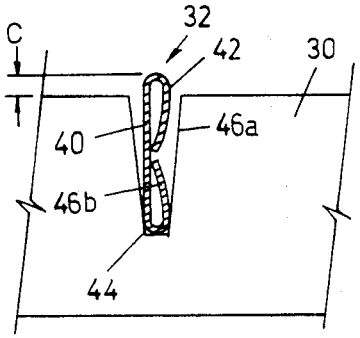
FIG. 6 is a section along 6—6 of FIG. 1.

Consequently, the strip members 32 as they are progressively forced into the notches 36, will be squeezed, somewhat in the manner shown in FIG. 6, although the precise configuration may vary from one installation to another.

As a result, the strip members 32 are securely held by frictional engagement in the notches 36. At the same time, the overall height H of the strip members 32 is somewhat greater than the depth from the bottom of the notch 36 to the upper edge of the strip 30. This will leave the upper fold portion 42 defining a clearance C, above the upper edges of the strip members 30.

The four pieces of the frame 10 are then assembled around the grid member 12, with the end tabs 34 and 50–52 fitting in the slots 18.

The four corners of the frame portions 10 are then spot welded in the manner shown in FIG. 3, securing the entire assembly.

When installed in a typical duct opening in a floor, the grid 12 according to the invention provides secure load bearing capability, sufficient to bear the weight of persons walking about on the floor, notwithstanding that the strip members 32 are of relatively light gauge thin sheet metal, as compared with the strip members 30.

In addition, the clearance C provided by the upper fold line 42 of the strip members 32 provides a smoother contoured surface on which persons may walk in comfort.

Figure 8:
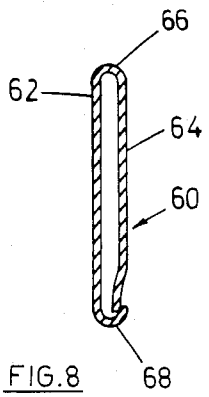
FIG. 8 is a section of an alternate form of roll-formed strip.

It will of course be appreciated that the strip members 32 may be made in other configurations. For example, an alternative configuration is shown in FIG. 8. In this configuration a strip member 60 comprises sidewalls 62–64, and an upper fold line 66.

The lower edge of the sidewall 62 is rolled over as at 68, closing securely around the lower edge of the sidewall 64.

Figure 9:
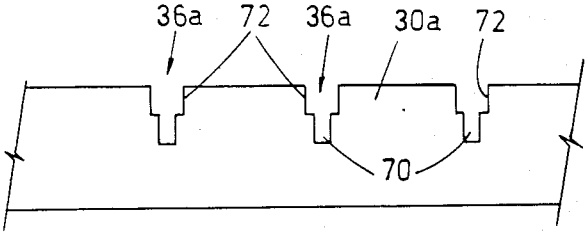
FIG. 9 is an elevation of a portion of an alternate form of strip.

Another alternate form of strip 30*a* is shown in FIG. 9. In this case the strip member 30*a* has notches 36*a* formed as a narrow throat portion 70, and a wider mouth portion 72. The side walls of both portions are parallel, but define different spacings, for ease of manufacture.

The foregoing is a description of a preferred embodiment of the invention which is given here by way of example only. The invention is not to be taken as limited to any of the specific features as described, but comprehends all such variations as come within the scope of the appended claims.

What is claimed is:

1. A lightweight load bearing register comprising:

a frame of strip sheet metal, formed into a generally L-shaped configuration along its length, said frame being formed in four pieces joined at four corners;

a supporting grid of groups of transverse and longitudinal strips of sheet metal supported at their ends by said frame;

a first one of said groups of said strips being formed of a single thickness of sheet metal, and with a plurality of notches formed therein at spaced intervals;

a second one of said groups of said strips being formed of two thicknesses of sheet metal, having a thickness thinner than one-half of the thickness of said first of said groups, said strips in said second group defining an elongated folded blade-like structure, with two side walls and a hollow interior spacing between said side walls, said spacing being substantially equal to the thickness of the sheet metal of which they are formed, and radiussed bends formed along at least their upper extremity, said second group of strip members being forced into said notches in said first group of strip members, said second group of strip members being squeezed, reducing the spacing between said opposite side walls thereof, and providing a good, tight frictional fit; and wherein said notches have a predetermined depth less than the overall height of said strips in said second group whereby said strips in said second group extend above said strips of said first group.

2. A lightweight load bearing register as claimed in claim 1 wherein said notches are formed with a flared mouth portion, tapering towards a reduced width notch portion.

3. A lightweight load bearing register as claimed in claim 1 wherein one end of each said frame piece at each corner is formed with an overlapping flange portion joined thereto by an offset junction bend whereby to underlie the adjacent end of the adjacent frame piece, and being spot welded thereto to provide a rigid corner construction.

4. A lighweight load bearing register as claimed in claim 1 wherein said strip members of said first group are formed of metal having a thickness T and wherein said strip members of said second group are formed of sheet metal having a thickness of about T/3.

5. A lightweight load bearing register as claimed in claim 1 wherein each said strip member of said second group has upper and lower extremities, and is formed of a panel of sheet metal folded over at said upper and lower extremities, and said panel forming a continuous side wall on one side of said strip member, and edges of said panel meeting on the other side wall of said strip member along a median line between said upper and lower extremities.

6. A lightweight load bearing register as claimed in claim 5 including end tab members extending from each end of said strip member of said second group, said tab members being formed by endwise extensions of said continuous side wall, and of said two partial side wall portions.

7. A lightweight load bearing register as claimed in claim 1 including hook members formed on opposite ends of said strip members of said first group, and corresponding hook receiving openings in two opposite sides of said frame, and including tab members formed on said strip members of said second group, and tab receiving openings formed in other two opposite sides of said frame.

8. A lightweight register as claimed in claim 1 wherein said notches are formed with a reduced width throat portion, having parallel sides, and a mouth portion of a greater width and having parallel sides.

9. A lightweight register as claimed in claim 3 including spot welding abutments formed in said overlapping flange portion.

10. A lightweight register as claimed in claim 1 wherein each said strip member of said second group has upper and lower extremities, and is formed of a panel of sheet metal folded over at said upper extremity, and said panel forms continuous walls on both sides extending downwardly to said lower extremity, and including an edge portion on one of said walls being folded over the edge of the other of said walls and defining the lower extremity.

* * * * *